United States Patent [19]

Cellier

[11] Patent Number: 4,717,338

[45] Date of Patent: Jan. 5, 1988

[54] HEATER DRUM FOR MANUFACTURING PROCESS

[75] Inventor: Jacques Cellier, Marlioz, France

[73] Assignee: Cellier S.A., Aix-Les-Bains, France

[21] Appl. No.: 851,328

[22] Filed: Apr. 14, 1986

[30] Foreign Application Priority Data

Apr. 12, 1985 [FR] France ..... 85 06078

[51] Int. Cl.[4] ..... F27B 9/28; H05B 3/02

[52] U.S. Cl. ..... 432/60; 432/228; 219/469; 34/124

[58] Field of Search ..... 34/119, 124; 432/60, 432/228, 236; 219/469, 470, 471, 10.61 A

[56] References Cited

U.S. PATENT DOCUMENTS

| | | | |
|---|---|---|---|
| 2,739,218 | 3/1956 | Wennerlund | 219/469 |
| 2,844,887 | 7/1958 | Hornbostel | 34/124 |
| 2,909,849 | 10/1959 | Hornbostel | 34/124 |
| 2,915,293 | 12/1959 | Justus et al. | 34/124 |
| 3,343,587 | 9/1967 | Triplett et al. | 34/124 |
| 3,452,967 | 7/1969 | Durand | 34/119 |
| 4,105,896 | 8/1978 | Schuster | 219/470 |
| 4,172,976 | 10/1979 | Namiki et al. | 219/469 |
| 4,229,644 | 10/1980 | Namiki et al. | 34/124 |
| 4,252,184 | 2/1981 | Appel | 34/124 |
| 4,284,875 | 8/1981 | Namiki et al. | 219/469 |

FOREIGN PATENT DOCUMENTS 2454742 5/1976 Fed. Rep. of Germany ..... 34/124

*Primary Examiner*—Henry C. Yuen

*Attorney, Agent, or Firm*—Karl F. Ross; Herbert Dubno

[57] ABSTRACT

A heater drum has an outer cylindrical wall centered on and rotatable about an axis, an inner cylindrical wall fixed concentrically within the outer wall and defining therewith an annular chamber, and a body of a heat-transmitting fluid in the chamber in heat-transmitting contact with both walls. A core body fixed nonrotatably about the axis inside the inner wall is heated to a high treatment temperature. This heat is transmitted radially from the core body to the inner wall. The walls are rotated jointly about the axis relative to the core body to distribute the heat of the inner wall via the fluid body to the outer wall. The chamber is at subatmospheric pressure and the fluid is partly vaporized and partly liquid at the high treatment temperature. The core body is of part-cylindrical section generally centered on the axis and has an outer surface spaced slightly radially inward of the inner wall. In addition the heat-transmission is via another body of heat-conducting liquid in contact with the outer surface of the core body and the inner wall. This liquid can be a fluorine compound or a silicone oil.

3 Claims, 4 Drawing Figures

PRIOR ART
FIG. 1
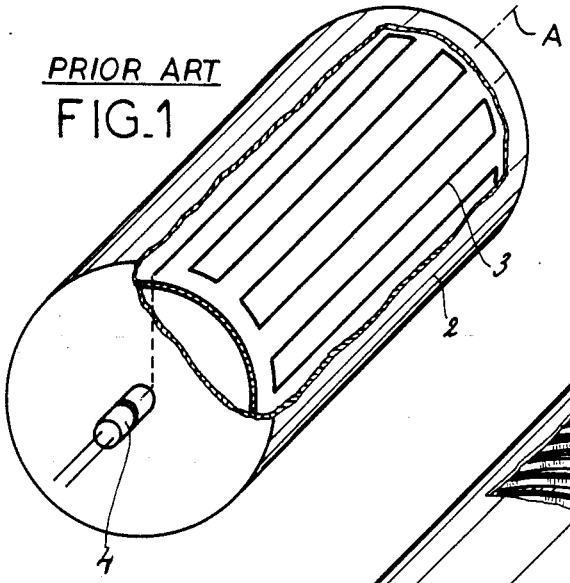
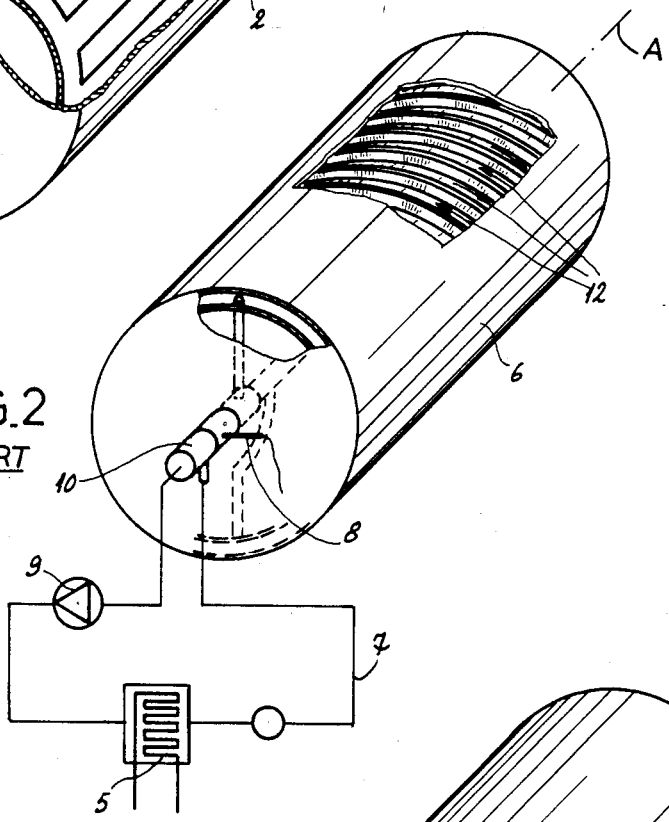
FIG. 2
PRIOR ART
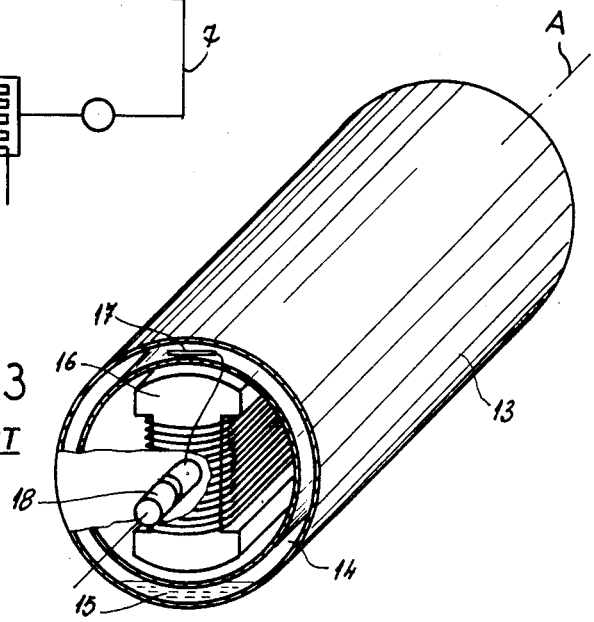
FIG. 3
PRIOR ART

HEATER DRUM FOR MANUFACTURING PROCESS

FIELD OF THE INVENTION

The present invention relates to a heater drum. More particularly this invention concerns such a drum used to heat a web of paper, synthetic resin, textile, leather, rubber, or the like in a manufacturing and/or treating process.

DESCRIPTION OF THE DRAWING

The invention and prior art will be described with reference to the accompanying drawing in which:

FIGS. 1, 2, and 3 are partly sectional perspective views of prior-art heater drums.

BACKGROUND OF THE INVENTION

Figure 4:
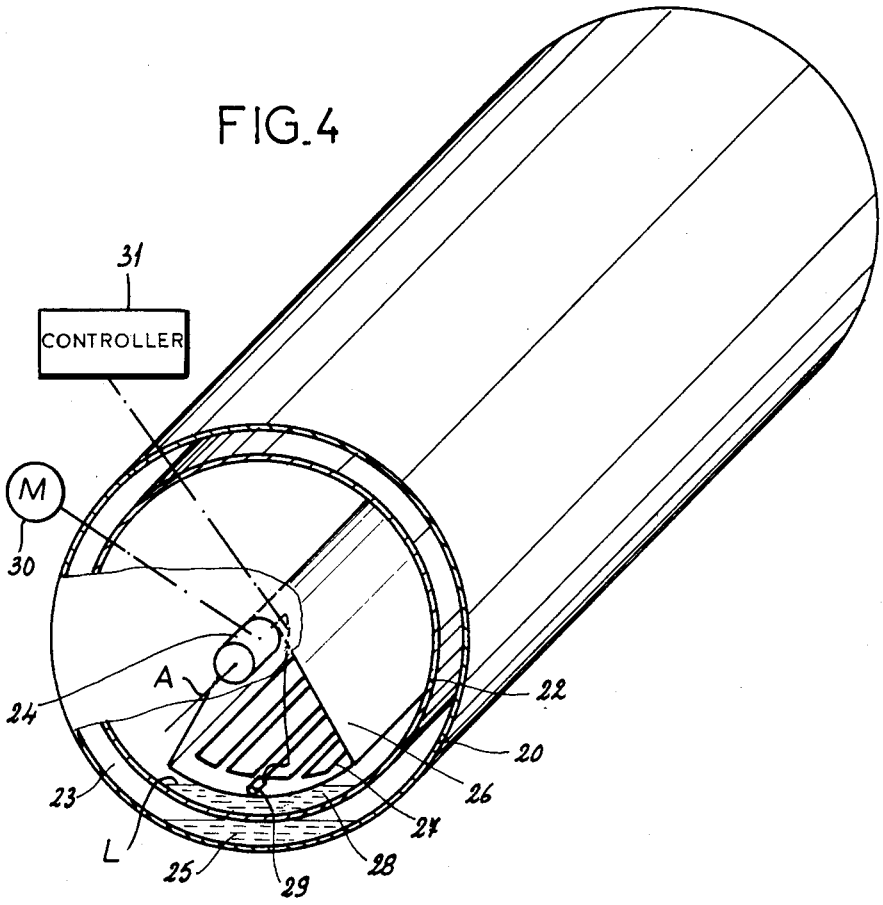
FIG. 4 is a partly sectional and schematic perspective view of a heater drum according to this invention.

The simplest heater drum used, for instance, for drying a rapidly moving web in a manufacturing process comprises as seen in FIG. 1 a cylindrical drum 2 rotatable about its axis A and provided internally with a resistive heater strip 3. Electricity is fed to this strip 3 via a commutator arrangement 4 carried on the shaft supporting the drum 2.

In most processes it is essential that the temperature be maintained with extreme uniformity, in the order of ±3° to 4° C. Thus in this arrangement it is standard to make the drum 2 of a fairly thick metal so that its heat inertia is great. Such a solution is not altogether satisfactory, as such massive construction means that it will take a long time for the drum to heat up initially, and any locally cooled spots will similarly take quite some time to get back up to temperature. Such slowness to heat up also means that if, for instance, the web being heated is particularly cool or moving particularly fast, the drum will be cooled off substantially before the control circuitry can respond and bring it back up to temperature.

Another disadvantage of the system of FIG. 1 is that its design requires one to calculate in advance the distribution of heat from the heating wires to the drum surface, and the loss of heat to the web. Thus the thickness of the drum and the spacing of the heating wires is worked out empirically for a particular process, that is in accordance with the temperature, speed, and heat capacity of the web being treated. As a result a system that is usable for a particular process is not usable for another.

Hence the system shown in FIG. 2 has been suggested. Here a helical chamber formed by a helical partition 12 between the walls of a double-walled drum is fed a liquid from a conduit system 7 passing through a resistance-type heater 5 and a pump 9. A complex rotating-seal joint 10 is provided to feed the heated liquid to the drum, and a temperature sensor 8 is provided to detect the temperature as the liquid exits the drum so that the heat applied at 5 can be adjusted accordingly. The liquid that is circulating therefore not only serves as the vehicle for transmitting the heat energy from the heater 5 to the relatively thin walls of the drum 6, and also to ensure that this heat is evenly distributed.

Such an arrangement, which is widely used in processes for manufacturing paper, synthetic resins, and rubber, operates most efficiently when the liquid is circulated at high speed and, therefore, at relatively high pressure. When extremely high temperatures are desired, it is standard to operate such a system with a vaporized liquid such as steam.

The disadvantages of this system are all related to the movement of a large volume of hot liquid. A great deal of the heat applied is lost in the remote heater 4 and piping 7 and the joint 10 is a frequent leak and service problem, as large volumes of very hot fluid must pass through it. Furthermore considerable energy is expended in simply circulating this fluid so that in general the energy wasted by the system is great.

The problems with the joint 10 have led to the use in high-speed, i.e. 4000 rpm to 500 rpm, applications of an arrangement like that shown in FIG. 3. Here the cylindrically annular chamber 14 of a double-wall drum 13 is largely evacuated and contains a body of liquid 15 that is mainly vaporized at the normal operating temperature. Such vapor utilizes the latent heat of evaporation and condensation to ensure extreme uniformity of temperature over the surface of the drum.

Heat is supplied by a so-called short-circuit transformer 16 which is stationary inside the drum and which creates a magnetic field that generates eddy currents in the rotating drum that in turn create heat that is distributed and made uniform by the vapor. Such a coil 16 is fairly expensive to manufacture and can normally only be used in relatively small-diameter drums.

In addition it is necessary to provide a temperature sensor 17 right in the rotating drum, so a commutator arrangement 18 must be provided to connect this sensor 17 to the control circuit that feeds electricity to the coil 16 in accordance with how much heat needs to be generated. Such a system is particularly hard to operate at the high rotation speeds it is intended to be used at.

OBJECTS OF THE INVENTION

It is therefore an object of the present invention to provide an improved heater drum for a manufacturing or treating process.

Another object is the provision of such a heater drum for a manufacturing or treating process which overcomes the above-given disadvantages, that is which is relatively inexpensive to make and operate, but that ensures extremely uniform heat distribution and fast compensation of any externally caused temperature variation.

SUMMARY OF THE INVENTION

A heater drum according to the invention has an outer cylindrical wall centered on and rotatable about an axis, an inner cylindrical wall fixed concentrically within the outer wall and defining therewith an annular chamber, and a body of a heat-transmitting fluid in the chamber in heat transmitting contact with both walls. A core body fixed nonrotatably about the axis inside the inner wall is heated to a high treatment temperature. This heat is transmitted radially from the core body to the inner wall. The walls are rotated jointly about the axis relative to the core body to distribute the heat of the inner wall via the fluid body to the outer wall.

Thus there is no problem with rotating connections for feeding liquid to the drum or to transmit electricity into parts in the drum. Instead the heating elements are stationary. At the same time excellent heat conduction and distribution is ensured by the fluid between the two walls of the drum.

According to another feature of this invention the chamber is at subatmospheric pressure and the fluid is partly vaporized and partly liquid at the high treatment temperature. This ensures excellent heat distribution.

In accordance with a further feature of this invention the core body is of part-cylindrical section generally centered on the axis and has an outer surface spaced slightly radially inward of the inner wall. In addition the heat-transmitting means is another body of heat-conducting liquid in contact with the outer surface of the core body and the inner wall. This liquid can be a fluorine compound or a silicone oil. Furthermore, the core body lies generally entirely below the axis, and the other body of liquid has a liquid level lying well below the axis. Thus there is no problem of sealing the interior of the inner wall, and the chamber between the inner and outer walls is substantially closed in a permanent manner so the liquid therein cannot possibly escape.

Similarly to simplify the system of this invention the means for heating the core body includes a heat sensor fixed in the core body. As a result there are no tricky moving connections to elements inside the drum.

SPECIFIC DESCRIPTION

As seen in FIG. 4 a heater drum according to this invention has a pair of coaxial cylindrical walls 20 and 22 defining a cylindrically annular chamber 23 that is centered on the axis A of the drum and that is partially filled by a body 25 of a heat-transmitting liquid. The chamber 23 is maintained at a subatmospheric pressure that is such that the liquid 25 is partly vaporized and partly liquid at the normal operating temperature range of the system, here 150° C. to 160° C. A motor 30 attached to the shaft 24 of the drum rotates same about the axis A at high speed, normally with a web to be heated in contact with the surface of the outer wall 20.

Inside the inner wall 22 is a stationary body 26 of quarter-cylindrical shape and of a radius slightly smaller than the inner radius of the wall 22. The two straight radial sides of the nonrotating body 26 are bisected by a vertical plane extending down from the axis A. Inside the wall 22 is another body 28 of heat-transmitting liquid, for example a silicone oil or a fluorine compound such as fluorocarbon, whose level L lies well below the axis A.

This body 26 is hollow and is provided internally with resistance heating wires 27 and a temperature sensor 29 both connected to and operated by a controller 31 to maintain this body 26 and the liquid 28 at the desired operating temperature. The liquid 28 ensures excellent heat transmission to the inner wall 22 and the liquid/vapor body 25 ensures both excellent heat transmission to the outside wall and nearly perfectly uniform distribution of this heat when the drum 20, 23 is rotating at high speed.

Since the body 26 and sensor 29 are stationary there is no problem connecting the controller 31 and electrical supply to them. Furthermore since the liquid level L is well below the axis A, there is no need to provide any particular joint to prevent leakage at the shaft 24.

I claim:

1. A heater drum comprising:

an outer cylindrical wall centered on and rotatable about an axis;

an inner cylindrical wall fixed concentrically within the outer wall and defining therewith a substantially closed annular chamber at subatmospheric pressure;

a body of a heat-transmitting fluid in the chamber in heat transmitting contact with both walls;

a core body fixed nonrotatably about the axis inside the inner wall out of direct contact therewith, of part-cylindrical section generally centered on the axis, lying generally below the axis, and having an outer surface spaced slightly radially inward of the inner wall;

means including a heat sensor fixed in the core body for heating the core body to a high treatment temperature and for thereby partly vaporizing the fluid in the chamber;

means including a body of heat-conducting liquid in simultaneous contact with the outer surface of the core body and with the inner wall for transmitting heat radially from the core body to the inner wall; and drive means for rotating the walls jointly about the axis relative to the core body and thereby distributing the heat of the inner wall via the fluid body to the outer wall.

2. The heater drum defined in claim 1 wherein the liquid is a fluorine compound or a silicone oil.

3. The heater drum defined in claim 1 wherein the liquid has a liquid level lying well below the axis.

* * * * *